United States Patent [19]

Shennett, Jr.

[11] 4,203,645

[45] May 20, 1980

[54] DEVICE FOR INSERTING A FUSE INTO AN ELECTRIC CIRCUIT

[75] Inventor: George D. Shennett, Jr., Amesbury, Mass.

[73] Assignee: Gould Inc., Rolling Meadows, Ill.

[21] Appl. No.: 966,639

[22] Filed: Dec. 5, 1978

[51] Int. Cl.[2] ..... H01R 9/18

[52] U.S. Cl. ..... 339/147 R; 339/263 L; 339/272 A

[58] Field of Search ..... 339/147 R, 263 R, 263 L, 339/272 R, 272 A, 272 UC

[56] References Cited

U.S. PATENT DOCUMENTS

| | | | |
|---|---|---|---|
| 2,059,467 | 11/1936 | Lowenstein | 339/263 R |
| 2,116,388 | 5/1938 | Eichblatt | 339/263 R |
| 2,246,356 | 6/1941 | Graham | 339/263 R |
| 3,736,550 | 5/1973 | Wallace et al. | 339/147 R |
| 4,118,098 | 10/1978 | Swift | 339/263 R |

*Primary Examiner*—John McQuade
*Attorney, Agent, or Firm*—Erwin Salzer

[57] ABSTRACT

A device for use in inserting an electric fuse into an electric circuit including a pair of cable connectors, fasteners which anchor themselves on one end by a self tapping screw to an insulating base, form spacers between said base and the pair of cable connectors, and a threaded machine screw on the other end to affix a fuse to said pair of cable connectors.

1 Claim, 5 Drawing Figures

DEVICE FOR INSERTING A FUSE INTO AN ELECTRIC CIRCUIT

BACKGROUND OF THE INVENTION

This invention is designed to effect insertion of an electric fuse into an electric circuit carrying current from a power source to electrical equipment. The current-carrying cables are capable of carrying current well in excess of that for which the equipment is rated. It is, therefore, common practice to insert fuses, in particular current-limiting fuses, into the cables which will effectively limit the current passing through the cables to a tolerable level, thereby protecting the equipment downstream of the current source.

The manner in which the fuse is conductively interconnected with the cables varies depending on the environment in which it is to be located, and the equipment which is to be protected.

In such applications the cables pass into a junction box or cabinet and are securely anchored therein. It is here that the fuse is located so as to be readily accessable if the need for replacement arises. One cable passes into the cabinet and is affixed in some manner to the fuse, another cable is affixed, usually in like manner, to the opposite end of the fuse and passes out of the cabinet. Such a system involves a pair of cable connectors which firmly clamp and hold the cables. The cable connectors are then conductively secured to a fuse and the entire assembly is made fast to a base which is fastened to the cabinet.

Heretofore, in order to accomplish affixing the cable connectors to the fuse and secure the same to, and in spaced relation with, a base required a plurality of parts, and operations. These limitations are obviated by the use of a fastener device according to the present invention.

Some prior art devices included a pair of supporting insulators for the cable connectors and a metal base.

Multifunction fasteners as used in the present invention are known in connection with other devices, but not in connection with fuse cable connectors.

SUMMARY OF THE INVENTION

A device according to this invention for inserting an electric fuse into an electric circuit includes a base of electric insulating material, and a pair of aligned cable connectors supported in spaced relation by said base. Said pair of cable connectors has axially outer cable receiving ends and axially inner perforated fuse blade supporting ends. An electric fuse having a pair of perforated blade contacts is supported by said blade supporting ends. A device according to the present invention further includes joint means for supporting said pair of cable connectors on said base and for supporting said pair of blade contacts on said blade-contact supporting ends of said cable connectors, said joint means include a pair of shafts having machine screw threaded ends projecting through said pair of perforated blade contacts and through said perforated blade contacts supporting ends of said cable connectors, intermediate portions of larger width than the outer diameter of said screw-threaded ends for spacing said blade contact supporting ends of said cable connectors from said base, and said shafts of said pair of screws having self-tapping lower ends projecting into said base of electric insulating material.

DESCRIPTION OF THE PREFERRED EMBODIMENT

Figure 1:
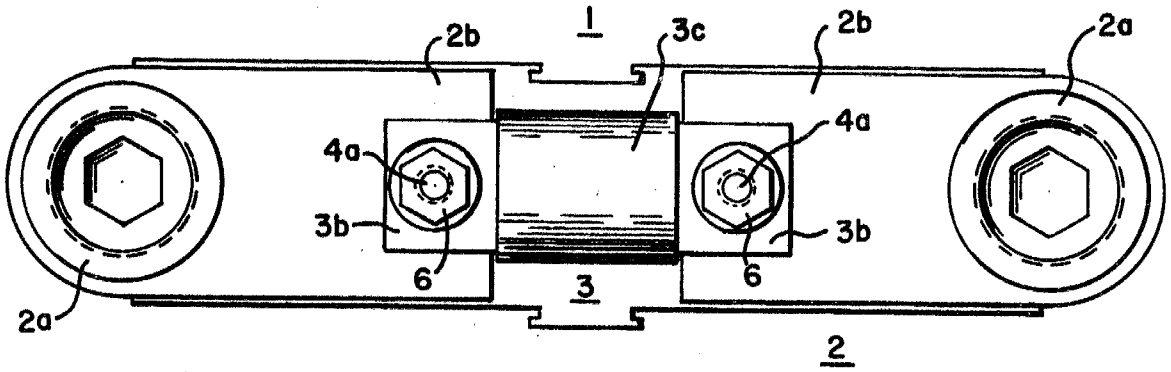
FIG. 1 is a top plan view of a device according to the present invention.
Figure 2:
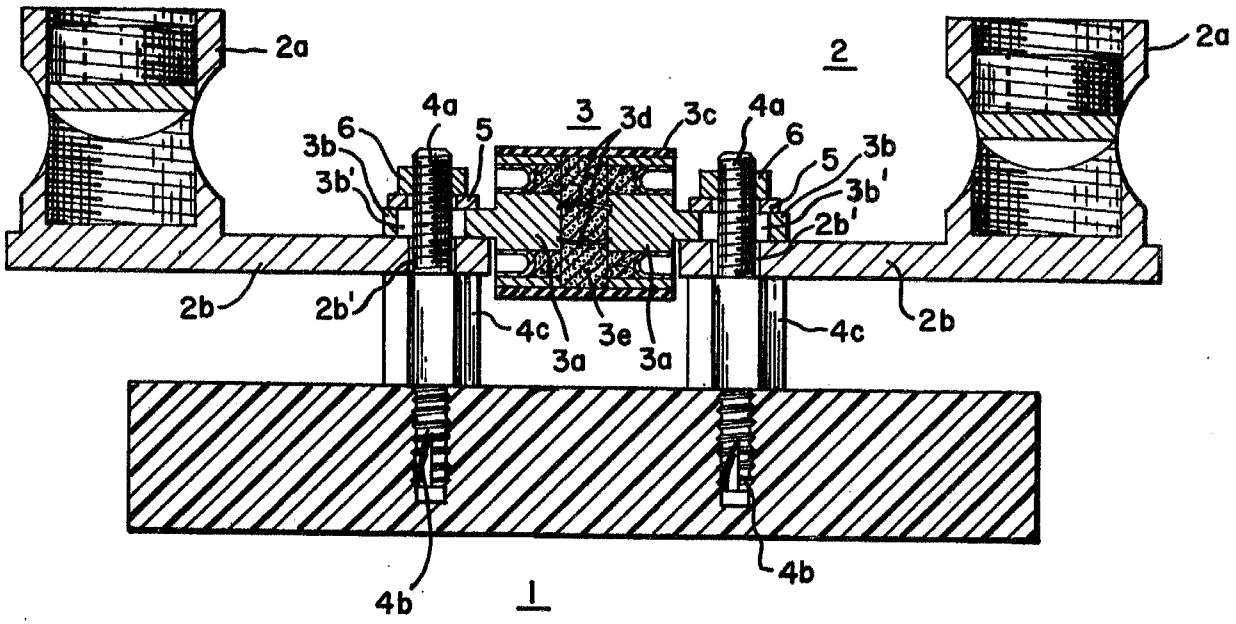
FIG. 2 is a longitudinal section of the device shown in FIG. 1.

Referring now to the drawings and more particularly to FIG. 1 thereof, numeral 1 has been applied to generally designate a base of synthetic electrical insulation which is molded by conventional methods to the desired configuration. Glass reinforced polyester has been found to lend itself particularly well to applications of the present kind. Numeral 2 has been applied to generally indicate a pair of cable connectors having axial outer ends 2a, receiving and clamping the ends of cables (not shown) having been stripped of insulation. Ends 2a firmly hold the ends of cables in place. Reference numeral 2b has been applied to indicate the axially inner fuse blade contact supporting ends of the cable connectors shown. Numeral 3 has been applied to generally indicate a blade type electric fuse having terminal elements 3a, blade contacts 3b, a cylindrical casing 3c and a pair of fusible elements 3d conductively interconnecting terminal elements 3a. Fusible elements 3d are embedded in a pulverulent arc-quenching filler to which reference character 3e has been applied. Blades 3a overlap the axially inner ends 2b of cable connector 2. Both parts 2b and 3b have aligned perforations 2b', 3'. The shaft of a machine screw 4a, more clearly shown in FIG. 2, projects through said aligned perforations and clamp said axially inner ends 2b of cable connectors 2 to fuse blades 3b by means of washers 5 and nuts 6.

The shafts of screws 4a have an integral portion 4c of increased width which spaces said electric fuse 3 and cable connectors 2 from base 1. This spacing and portions 4c are important for a number of reasons. They provide the necessary clearance between the body of the fuse and the insulating base and allow air to circulate around the entire fuse which facilitates cooling. Portions 4c also act as heat sinks, drawing heat which is conducted by the blades 3b away from fuse 3. Spacing member 4c has an external configuration such that a common wrench or similar tool may engage and facilitate axial rotation thereof.

The spacing portion 4c of the shafts of machine screws 4a have self-tapping ends 4b which project into the base of synthetic electric insulating material 1. Said self-tapping ends 4b taper radially inwardly from spacing portion 4c presenting a portion of relatively small diameter and surface area, remote from said spacing portion 4c, for initial penetration of base 1 followed by portions of increasing diameter and relatively large surface area which ensures sufficient contact and consequent holding power between the mating surfaces. Self-tapping ends 4b owe their self-tapping nature to a portion which as been removed from the axial end 4b of the shank that forms parts 4a, 4c and 4b. Thus a cutting edge for the threads to be formed in base 1 is established and a receptacle for the material which is displaced by the self-tapping screw is formed.

Figure 4:
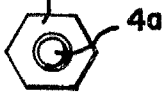
FIG. 4 is a top view of the fastener shown in FIG. 3.
Figure 3:
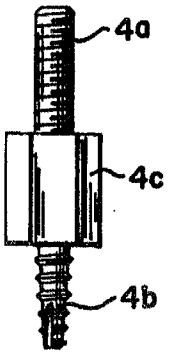
FIG. 3 is a front view of the fastener used in this invention.
Figure 5:
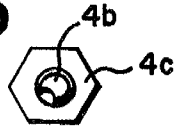
FIG. 5 is a bottom view of the fastener shown in FIG. 3.

FIGS. 4 and 5 are a top and bottom view, respectively, of the fastener *4a,4b,4c*. FIG. 5 shows the relief provided in self-tapping end *4b*.

I claim as my invention:

1. A device for inserting an electric fuse into an electric circuit comprising:

(a) a base of electric insulating material;

(b) a pair of aligned cable connectors supported in spaced relation by said base, said pair of cable connectors having axially outer cable receiving ends and axially inner perforated blade contact supporting ends;

(c) an electric fuse having a pair of perforated blade contacts supported by said blade contact supporting ends of said cable connectors; and (d) joint means for supporting said pair of cable connectors on said base and for supporting said pair of blade contacts on said blade contact supporting ends of said cable connectors, said joint means comprising a pair of shafts having upper machine-screw-threaded ends projecting through said pair of perforated blade contacts and through said perforated blade contact supporting ends of said cable connectors, intermediate portions of larger width than the outer diameter of said machine-screw-threaded ends for spacing said blade contact supporting ends of said cable connectors from said base, and said shafts having self-tapping lower ends projecting into said base.

* * * * *